US006729051B1

(12) United States Patent
Hollen

(10) Patent No.: US 6,729,051 B1
(45) Date of Patent: May 4, 2004

(54) FRONT END LOADER RETRACTABLE ATTACHMENT

(75) Inventor: James P. Hollen, Thomasville, NC (US)

(73) Assignee: APAC Inc., Atlanta, GA (US)

( * ) Notice: Subject to any disclaimer, the term of this patent is extended or adjusted under 35 U.S.C. 154(b) by 85 days.

(21) Appl. No.: 10/041,994

(22) Filed: Jan. 9, 2002

(51) Int. Cl.[7] ..... E02F 3/96
(52) U.S. Cl. ..... 37/404
(58) Field of Search ..... 37/408, 403, 404, 37/405, 409, 410, 443, 444

(56) References Cited

U.S. PATENT DOCUMENTS 3,034,238 A * 5/1962 McGee ..... 172/777
3,112,573 A * 12/1963 Morass et al. ..... 172/271
3,596,996 A * 8/1971 Carter ..... 299/10
3,702,712 A * 11/1972 Cairns, III ..... 299/67
3,778,111 A * 12/1973 Ciofani ..... 299/67
4,041,624 A * 8/1977 Fryrear ..... 37/404
4,204,348 A * 5/1980 Lydie ..... 37/404
4,457,085 A * 7/1984 Arnold ..... 37/444
4,512,090 A * 4/1985 Billings ..... 37/405
4,531,883 A * 7/1985 Arnold ..... 414/722
4,967,850 A * 11/1990 Bargfrede et al. ..... 172/197
5,197,212 A * 3/1993 Vail ..... 37/403
5,456,028 A * 10/1995 Larson ..... 37/404
5,564,885 A * 10/1996 Staben, Jr. ..... 414/724
6,023,863 A * 2/2000 Mahin ..... 37/404
6,311,417 B1 * 11/2001 Pratt ..... 37/404
6,434,863 B1 * 8/2002 Meurer ..... 37/410
6,546,650 B1 * 4/2003 Meurer ..... 37/405

* cited by examiner

*Primary Examiner*—Thomas B. Will
*Assistant Examiner*—Kristine Florio
(74) *Attorney, Agent, or Firm*—Frank J. Kowalski

(57) ABSTRACT

An attachment for a front end loader that provides a method and apparatus for ripping solid ground that includes a hollow tube mounted between the arms of a front end loader directly behind the bucket. The hollow tube is slidably mounted on a solid shaft. Closely machined bushings are welded and braced on support brackets on the inside bottom surface of the arms of the loader. These closely machined bushings are adapted to receive the shaft which extends from the ends of the hollow tube. Ripper brackets are welded to the exterior surface of the hollow tube. On the end of each ripper bracket are mounted ripper teeth in a manner such that the pointed ends of the teeth are pointing towards the rear of the front end loader. Connecting rods are attached to both the hollow tube and the loader bucket. When the bucket is tilted toward the operator the hollow tube rotates downward to a ripping position. When the bucket is leveled the hollow tube rotates upward lifting the ripping teeth up and away from the ground surface. Braces are fixed to the hollow tube and blocks are mounted on the brackets to receive the strain of a ripping operation. To begin a ripping operation, the operator tilts the bucket toward the operator, rotating the ripping teeth downward and backs up. To cease a ripping operation, the operator stops and tilts the bucket downward away from the operator to a level position.

6 Claims, 3 Drawing Sheets

FRONT END LOADER RETRACTABLE ATTACHMENT

BACKGROUND OF THE INVENTION

1. Field of the Invention

The present invention relates to attachments for front end loaders and more particularly to attachments used in ripping pavement or the surface of the ground.

2. Related Art

There are several types of ripping attachments in the present art for ripping pavement or any solid ground surface to allow further excavating or replacement. In general, prior art has several deficiencies, two of which center around the method in which the ripping is normally done.

First, most ripping attachments are mounted in conjunction with the bucket of the front end loader. This arrangement puts excessive strain on the bucket, using it for a task for which it was not designed. The bucket, while being capable of digging into ground, was not designed to rip into pavement or concrete.

Second, The ripping attachments are used in the forward direction. When the front end loader is being used in conjunction with a ripper attachment, operating it in the forward direction limits the duration for which it is used. In going forward while ripping, materials such as rocks and other debris accumulate in the bucket and must be emptied from time to time.

Some United States patents that are indicative of the state of the art are as follows.

U.S. Pat. No. 4,151,664, titled "Ripper Attachment for Backhoe or Front End Loader", issued to Nicholas Maura, relates to an attachment which, for a backhoe bucket, includes a pair of connected rippers attached to the inside of the bucket and for a front end loader, at least three connected rippers attached inside the bucket. The rippers are attached by pins to the sides and upper bottom portion of the bucket. The earth engaging ends of the rippers are above the bucket edge so that the rippers will dislodge earth which subsequently falls into the bucket and the bucket edge can be used for the finish work without ripper interference.

U.S. Pat. No. 5,564,885, titled "Multipurpose Work Attachment for a Front End Loader", issued to Frank P. Staben, Jr., relates to a work attachment for a front end loader of the type having hydraulically actuated frame arms for supporting and manipulating a work attachment at the front of the vehicle. The work attachment includes a scoop or bucket in combination with a laterally extending row of ripper teeth mounted at the lower edge of the bucket and adapted for hydraulic actuation between an upper stored position and a downwardly extending deployed position for ripping earth upon vehicle movement in a reverse direction. The teeth are also used for retaining and locking and auxiliary attachment such as a fork lift unit onto the bucket. Additionally, an hydraulically actuated grapple hook can be mounted onto the bucket for use in combination with the bucket and fork lift unit.

The main problem with this device is that all the digging strain is put on the bucket and the hydraulics which actuate the ripper teeth. This arrangement was designed to work on the small skid-steer front end loaders marketed by Melroe Company under the trademark BOBCAT. Although it may be suitable these light duty front end loaders, its design is unsuitable for heavy equipment, such as that used in highway repair and construction.

SUMMARY OF THE INVENTION

The present invention provides a solution to the deficiencies of prior art in a method and apparatus for ripping solid ground or even pavement. As an apparatus, the present invention includes an attachment for a front end loader which includes a hollow tube mounted on a shaft between the arms of a front end loader directly behind the bucket of the loader. Closely machined bushings are welded and braced on the inside bottom surface of metal brackets fixed to the arms of the loader. These closely machined bushings are adapted to receive the shaft which is longer than the tube which covers it and extends out from the ends of the hollow tube. Ripper brackets are welded to the exterior surface of the hollow tube. Ripper teeth are mounted on the end of each bracket in a manner such that the pointed ends of the teeth are pointing towards the rear of the front end loader. Connecting rods are attached to both the exterior cylindrical surface of the hollow tube and the back surface of the loader bucket. When the bucket is tilted toward the operator, the hollow tube, through the operation of the connecting rods, rotates downward to a ripping position. Stops are welded on the metal brackets fixed to the arms of the front end loader and operate in cooperation with flanges mounted on the outer periphery of the ends of the hollow tube. When the bucket is tilted upward, the hollow tube rotates downward until the flanges come in contact with the stops. The bucket carrying the attachment having the ripping teeth, may be lowered to place the ripping teeth in contact with the ground. At this time the pointed ends of the ripping teeth are directed toward the ground and the back of the front end loader. The stops welded on the arms in cooperation with the flanges on the hollow tube receive the strain of a ripping operation.

To disengage, the bucket and ripping teeth may be raised by the front end loader arms. The bucket is then tilted to the level position. When the bucket is level the connecting rods force the hollow tube to rotate upward lifting the ripping teeth up and away from the ground surface.

To begin a ripping operation, the operator tilts the bucket upward, rotating the ripping teeth downward. The front end loader arms are lowered and the ripping teeth come in contact with the ground surface and can even be forced into the surface, whether solid ground or pavement. The operator then places the front end loader in reverse and backs up. Because of the configuration of the ripping teeth and the bucket, the operator may back up any distance required without having to stop and empty the bucket.

To cease a ripping operation, the operator stops the front end loader and lifts the arms. This lifts the bucket and ripping teeth. The operator tilts the bucket downward to a level position, which directs the points of the ripping teeth upward and away from the ground so that the operator may now perform smoothing or leveling work.

The present invention provides an apparatus for attachment to the arms of a front end loader having a front bucket that has machined bushings welded and braced on metal brackets fixed to the side of the front end loader arms. A hollow tube is mounted on a shaft between the arms with the shaft adapted to attach to the machined bushings. Ripper brackets are mounted to the outside of the hollow tube and ripping teeth are fixed to the end of each of the ripper brackets. Connecting rods are attached to the hollow tube and the bucket of the front end loader. The shaft is configured to extend from the ends of the hollow tube into the machined bushings. Stops are welded on the metal brackets on the arms of the front end loader to butt against welded members on the ends of the hollow tube when the bucket is tilted upward. These stops prevent contact between the riper brackets on the hollow tube and the bucket.

The present invention also provides a method for ripping a ground surface using a front end loader having a bucket that includes attaching a hollow tube having brackets with ripper teeth mounted thereon between the arms of the front end loader. The hollow tube is secured to the bucket so that the hollow tube moves in conjunction with the bucket. Stops are fixed to the arms of the front end loader to prevent contact between the brackets and the bucket. The bucket is tilted upward causing the ripper teeth to point downward and toward the back of the front end loader. The front end loader arms are lowered and the front end loader is backed up. To cease operation, the front end loader is stopped, the front end loader arms are lifted and the bucket is tilted downward to the level position causing the ripper teeth to point upward away from the ground surface.

DESCRIPTION OF THE PREFERRED EMBODIMENT

The present invention provides a method and apparatus for ripping solid ground or even pavement. The present invention includes an attachment for a front end loader which includes ripping teeth mounted on brackets extending from a hollow cylinder mounted between the arms of the front end loader. The hollow cylinder or tube is fixed to operate in conjunction with the front end loader bucket and includes an independent stopping system.

Figure 1:
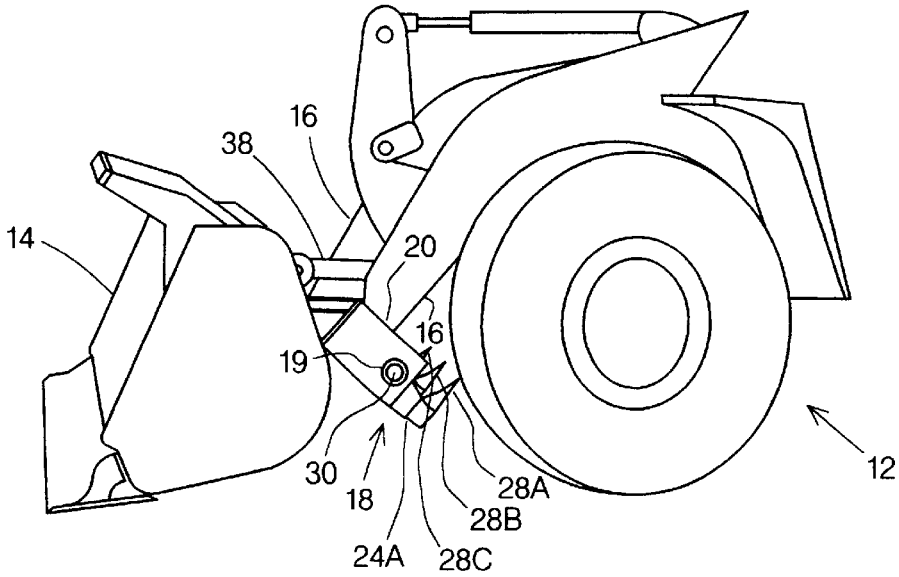
FIG. 1 is a partial plan view of the front portion of a front end loader having a ripping attachment mounted on the arms of the front end loader.

Referring now to FIG. 1, the front portion of a front end loader 12 is illustrated with a bucket 14 tilted down for grading and arms 16 in the lowered position. Also illustrated is ripper attachment 18 retracted and out of the way of movement of front end loader 12. Machined bushings 19 are mounted between metal brackets 20A and 20B, which are welded on each of arms 16.

Ripper attachment 18 includes a hollow tube 22 (see FIG. 3) having machined brackets 24A, 24B and 24C welded on outer surface 26. Ripper teeth 28A, 28B and 28C are mounted on brackets 24A, 24B and 24C, respectively, preferably by welding. Hollow tube 22 is rotatably mounted on and fits closely to a pin 30. Pin 30 is preferably made of steel or other durable material that can withstand the strain of the ripping force when in operation.

Figure 2:
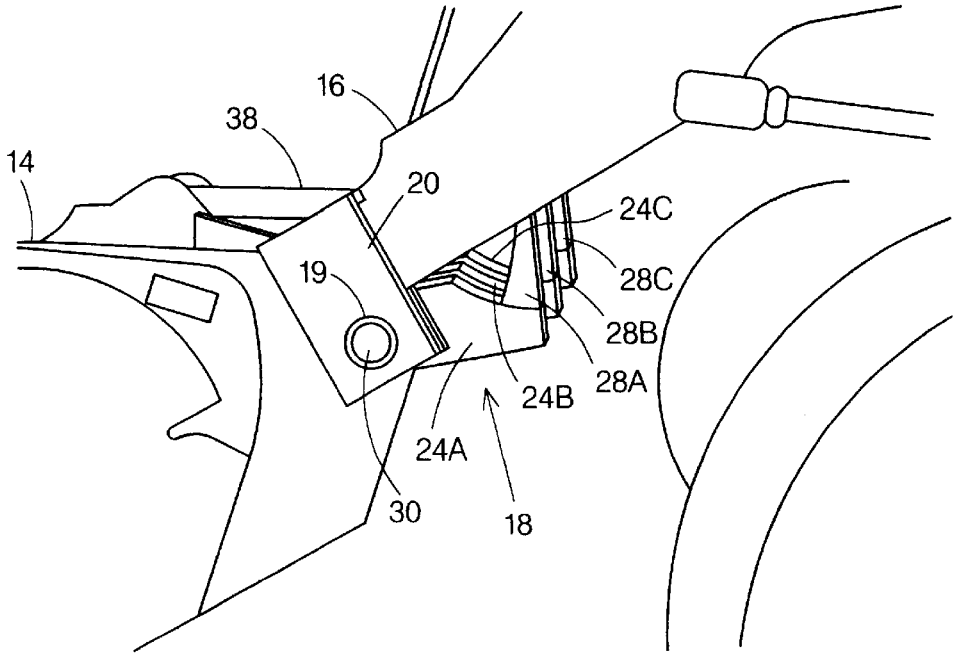
FIG. 2 is a side plan view of the front end loader bucket of FIG. 1 in the lowered position with the ripper teeth in the up position.

Referring now to FIG. 2, closely machined bushings 19 are welded and braced between brackets 20 mounted on the inside bottom surface of arms 16 of loader 12 and are adapted to receive steel pin 30 extending from the ends of hollow tube 22. Machined bushings 19 are preferably solid metal bushings that fit tightly around pin 30, and are highly greased to permit relatively free rotation. Other types of bushings may be used, such as bearing type, however, the solid type is preferred since the ripping force of operation will concentrate great stress on a small area of the circumference of the roller portion of the bearings.

Brackets or "arms" 24A, 24B and 24C are welded to the exterior cylindrical surface 26 of hollow tube 22. On the ends of each arm are mounted ripping teeth 28A, 28B and 28C in a manner such that the pointed ends of the teeth are pointing towards the rear of front end loader 12.

Figure 3:
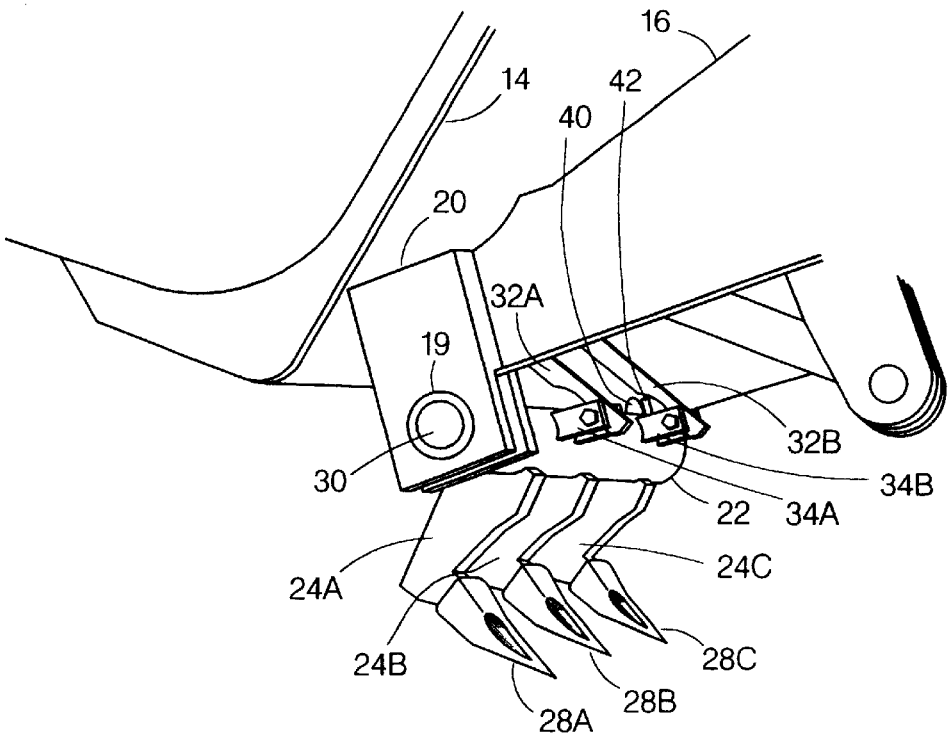
FIG. 3 is a side plan view of the front end loader bucket of FIG. 1 in the raised position with the ripper teeth in the lowered position.
Figure 4:
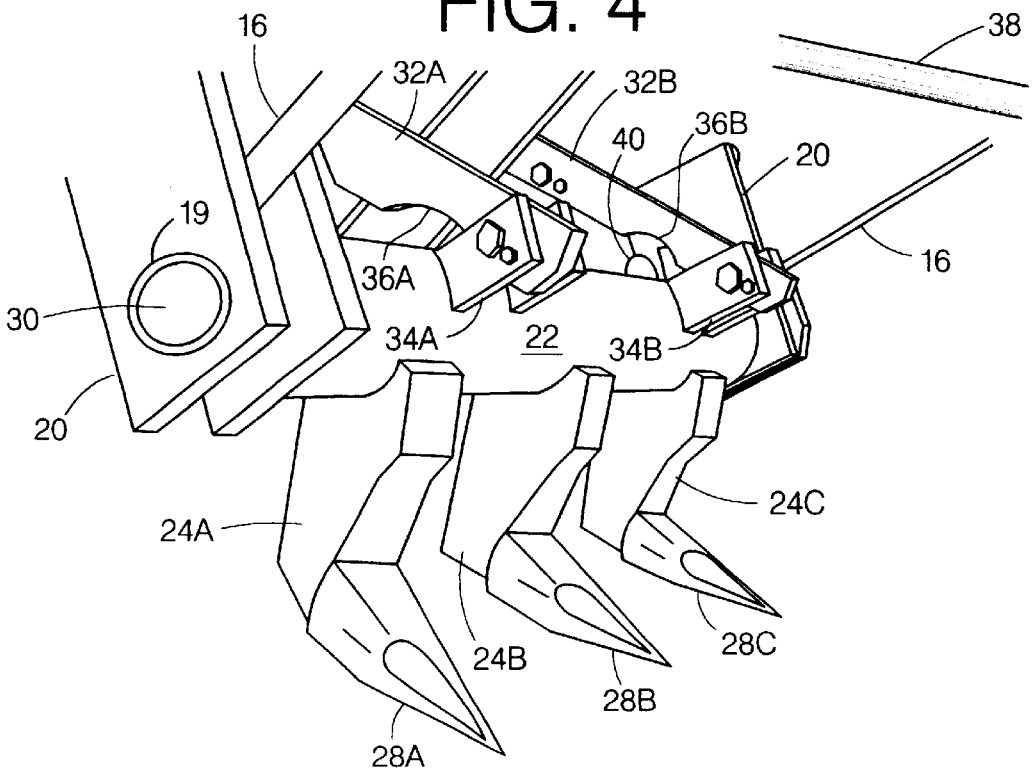
FIG. 4 is an underneath plan view of the front end loader bucket of FIG. 3 illustrating the connection rods between the bucket and the ripper teeth.

Referring now to FIG. 3, connecting rods 32A and 32B are illustrated as attached to exterior cylindrical surface 26 of hollow tube 22 at connecting brackets 34A and 34B and the back surface of loader bucket 14. These connections are also solid sliding connections that have been generously greased. Bearing type bushings may be used at the rotation points, however, the rotation is not of a continuous type and bearing would add unnecessary cost and could provide an area of needed replacement.

Connecting rods 32A and 32B have cutouts 36A and 36B to permit complete motion. When bucket 14 is tilted toward the operator through hydraulic cylinder 38 (see FIGS. 1 and 2), hollow tube 22, through the operation of connecting rods 32A and 32B, rotates downward to a ripping position. Arms 16, carrying hollow tube 22 with ripping teeth 28A, 28B and 28C, may be lowered to place ripping teeth 28A, 28B and 28C in contact with the ground. At this time the pointed ends of ripping teeth 28A, 28B and 28C are directed toward the ground and the back of front end loader 12.

To disengage, arms 16, carrying bucket 14 and ripper attachment 18, may be raised and moved away from the ground. Bucket 14 is then tilted to the level position. When bucket 14 is level, connecting rods 32A and 32B force hollow tube 22 to rotate upward lifting ripping teeth 28A, 28B and 28C up and away from the ground surface.

Figure 5:
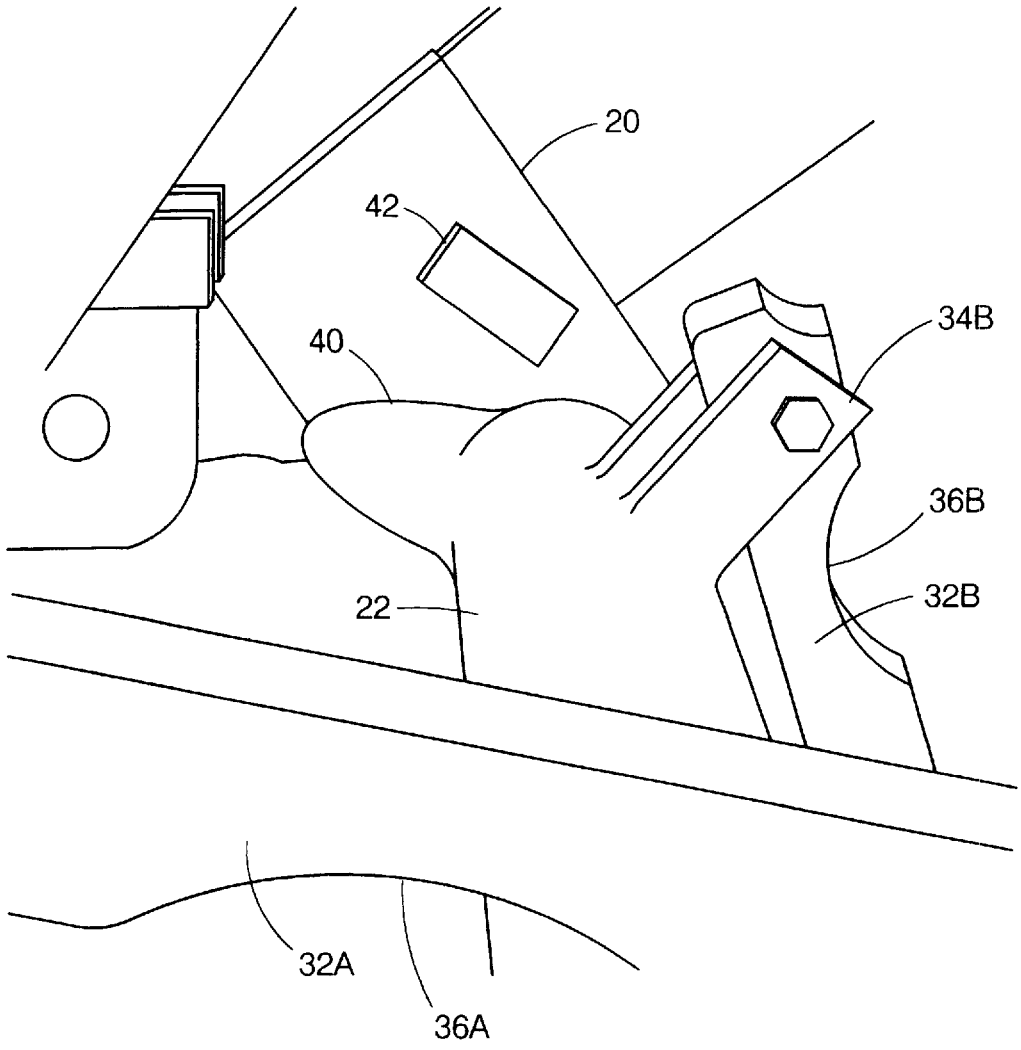
FIG. 5 is a side view illustrating the mechanical stops which hold the ripper teeth in position while in operation.

In FIG. 5, the stopping mechanism for preventing over rotation is illustrated. Connecting rod 32B has been detached to permit a clearer view of stop 40 and block 42. Stops 40 are welded on the end of hollow tube 22. Blocks 42 are welded onto brackets 20 to receive stops 40. When bucket 14 is tilted toward the operator of front end loader 12, ripper attachment 18 rotates on pin 30 to direct ripping teeth 28A, 28B and 28C down toward the ground. The rotation moves stops 40 to come in contact with blocks 42, preventing over rotation. The contact between stops 40 and blocks 42 receives the entire force exerted on ripping teeth 28A, 28B and 28C through the strain of a ripping operation.

In operation, hollow tube 22 is secured to bucket 14 so that hollow tube 22 moves in conjunction with bucket 14. When bucket 14 moves or is tilted upward, hollow tube 22 is rotated downward through the operation of connecting rods 32A and 32B. When hydraulic cylinder 34 pulls bucket 14 to tilt it upward, ripper attachment points down because the pivot point of bucket 14 is below the connection point of connecting rods 32A and 32B and bucket 14.

Connecting brackets 34A and 34B are extended out from hollow tube 22 to permit rotation motion when connecting rods 32A and 32B are forced down. Connecting rods 32A and 32B have cutouts 36A and 36B respectively to permit full rotation of hollow tube 22 without connecting rods 32A and 32B from interfering with its motion.

Stops 40 are fixed to hollow tube 22 to operate in conjunction with blocks 42 mounted on brackets 20 fixed to arms 16 of front end loader 12 to prevent contact between brackets 24A, 24B and 24C and bucket 14. Bucket 14 is tilted upward causing ripping teeth 28A, 28B and 28C to point downward and toward the back of front end loader 12. Arms 16 of front end loader 12 are lowered, bringing ripping teeth 28A, 28B and 28C in contact with the ground. Front end loader 12 is backed up.

To cease operation, front end loader 12 is stopped, arms 16 are lifted and bucket 14 is tilted downward to the level position causing ripping teeth 28A, 28B and 28C to point upward away from the ground surface.

While there has been illustrated and described a particular embodiment of the present invention, it will be appreciated that numerous changes and modifications will occur to those skilled in the art, and the present invention should not be limited thereto. It is intended that the present invention cover all those changes and modifications which fall within the true spirit and scope of the appended claims.

What is claimed is:

1. An apparatus for attachment to the arms of a front end loader having a bucket comprising:

machined bushings fixed to support brackets welded on the side of said arms;

a shaft removeably mounted between said arms and adapted to attach to said machined bushings;

a hollow tube rotatably mounted on said shaft;

ripper brackets mounted to the outside of said hollow tube;

ripping teeth fixed to an end of said ripper brackets; and connecting rods attached to said hollow tube and said bucket of said front end loader wherein said connecting rods include cutouts to permit complete motion of said hollow tube.

2. The apparatus according to claim 1 also including:

a stopping system to restrict motion of said hollow tube.

3. The apparatus according to claim 2 wherein said stopping system includes:

braces fixed to a predetermined portion of the end of said hollow tube; and blocks mounted on said support brackets for receiving said braces when said hollow tube is rotated.

4. A method for ripping a ground surface using a front end loader having a bucket comprising:

attaching a hollow tube having brackets with ripper teeth mounted thereon between the arms of said front end loader;

securing said hollow tube to said bucket so that said hollow tube moves in conjunction with said bucket;

fixing braces on the ends of said hollow tube;

mounting stops to said arms of said front end loader to contact said braces to receive ripping force during operation;

tilting said bucket upward causing said ripper teeth to point downward and toward the back of said front end loader;

lowering said front end loader arms;

backing up said front end loader to rip said ground surface;

stopping said front end loader;

lifting said front end loader arms;

tilting said bucket downward to the level position causing said ripper teeth to point upward away from said ground surface; and moving said front end loader forward using said bucket to grade said ground surface.

5. The method according to claim 4 wherein said attaching a hollow tube includes:

providing a solid rod between said arms of said front end loader; and configuring said hollow tube on said solid rod such that said hollow tube rotates on said solid rod.

6. A ripping system for operation with the arms of a front end loader having a bucket comprising:

machined bushings fixed to support brackets welded on the side of said arms;

shaft removeably mounted between said arms and adapted to attach to said machined bushings;

hollow tube rotatably mounted on said shaft;

ripper brackets mounted to the outside of said hollow tube;

ripping teeth fixed to an end of said ripper brackets; and connecting rods attached to said hollow tube and said bucket of said front end loader, said connecting rods having cutouts to permit complete motion of said hollow tube;

stopping system to restrict motion of said hollow tube, said stopping system including braces fixed to a predetermined portion of the end of said hollow tube and blocks mounted on said support brackets for receiving said braces when said hollow tube is rotated.

* * * * *